United States Patent [19]

Baron

[11] 3,990,161

[45] Nov. 9, 1976

[54] CROWD SYSTEM FOR POWER SHOVELS

[75] Inventor: George B. Baron, Marion, Ohio

[73] Assignee: Marion Power Shovel Company, Inc., Marion, Ohio

[22] Filed: Oct. 1, 1975

[21] Appl. No.: 618,420

[52] U.S. Cl. ..... 37/103; 214/138 R; 214/141; 214/770

[51] Int. Cl.[2] ..... E02F 5/02; B60P 1/04

[58] Field of Search ..... 37/103, 117.5; 214/131 R, 133, 135 A, 136, 138 R, 140, 141 R, 145 R, 770, 510

[56] References Cited

UNITED STATES PATENTS

| | | | |
|---|---|---|---|
| 2,764,306 | 9/1956 | Dorkins | 37/117.5 |
| 2,784,855 | 3/1957 | Acker | 214/138 R |
| 2,828,038 | 3/1958 | Dorkins | 214/138 R X |
| 3,080,076 | 3/1963 | Randall | 214/138 R |
| 3,094,229 | 6/1963 | Johnson et al. | 214/138 R |
| 3,425,574 | 2/1969 | Willgrubs et al. | 214/135 R |
| 3,491,906 | 1/1970 | Davidson | 214/141 X |
| 3,501,034 | 3/1970 | Baron | 214/138 R |
| 3,608,755 | 9/1971 | Solokhin et al. | 37/103 X |
| 3,648,863 | 3/1972 | Baron et al. | 214/138 R |
| 3,856,161 | 12/1974 | Baron | 214/138 R |

FOREIGN PATENTS OR APPLICATIONS

| | | | |
|---|---|---|---|
| 167,063 | 2/1956 | Australia | 214/138 R |
| 1,428,942 | 1/1966 | France | 37/103 |

*Primary Examiner*—E. H. Eickholt
*Attorney, Agent, or Firm*—Mason, Fenwick & Lawrence

[57] ABSTRACT

A crowd system for a power shovel having a front end assembly including a dipper mounted on a body, and means mounted on the body and operatively connected to the front end assembly for hoisting and lowering the dipper, comprising a mast pivotally connected at a lower end thereof to the body, at least one connecting link pivotally connected at opposite end thereof to the mast and the front end assembly, at least one support link pivotally connected at a lower end thereof to the body, a drive link pivotally connected at opposite end thereof to the mast and the support link, a gantry mounted on the body between the mast and the support link, at least one fluid actuated, piston and cylinder assembly pivotally connected at one end thereof to the gantry at a point elevated relative to a support platform of the body, and pivotally connected at the opposite end thereof to the drive link, and means for selectively supplying fluid under pressure to the opposite ends of the cylinder of the piston and cylinder assembly to correspondingly extend and retract such assembly.

12 Claims, 5 Drawing Figures

CROWD SYSTEM FOR POWER SHOVELS

This invention relates to power shovels and more particularly to an improved crowd system for a power shovel.

Generally, conventional crowd systems for power shovels have involved either a crowd drum and drive or fluid actuated piston and cylinder assemblies mounted on the main deck of the shovel, operatively connected by various arrangements of structural components, linkages and/or ropes to the front end assembly of the shovel, for crowding and retracting the dippers thereof. Such prior art systems have been found not to be entirely satisfactory in design and performance in that they often occupy a considerable amount of space on the main deck of the shovel thus complicating the layout or arrangement of other components and equipment on the main deck, present a substantial safety hazard to operating personnel on the shovel, are not adapted to convenient and efficient servicing, and are inefficient in operation. It thus has been found to be desirable to provide an improved crowd system for a power shovel having design and performance characteristics sufficient to overcome the aforementioned shortcomings of prior art crowd systems.

Accordingly, it is the principal object of the present invention to provide an improved crowd system for a power shovel.

Another object of the present invention is to provide an improved crowd system for a power shovel which requires a comparatively smaller amount of space of the support platform or deck of the shovel than comparable, conventional power shovels.

A further object of the present invention is to provide an improved crowd system for power shovels where the components are more readily accessible to maintenance personnel thus facilitating the servicing of the system.

A still further object of the present invention is to provide a crowd system for power shovels wherein no moving components thereof are located in areas normally occupied or frequented by operating personnel, thus enhancing the safety of such shovel.

Another object of the present invention is to provide an improved crowd system for a power shovel, utilizing fluid actuated, piston and cylinder assemblies.

A further object of the present invention is to provide an improved crowd system for power shovels, utilizing fluid actuated, piston and cylinder assemblies, wherein the operating efficiency of such system is enhanced.

A still further object of the present invention is to provide an improved crowd system for a power shovel, utilizing fluid actuated, piston and cylinder assemblies for powering such system, which system facilitates an efficient arrangement of components and equipment mounted and installed on the support platform or main deck of the shovel.

Another object of the present invention is to provide an improved crowd system for a power shovel, utilizing fluid actuated, piston and cylinder assemblies for powering such system, in which the center of gravity of such system is disposed further aft than comparable, conventional power shovels.

A further object of the present invention is to provide an improved crowd system for a power shovel, utilizing fluid actuated, piston and cylinder assemblies for powering such system, having improved kinematic characteristics.

Other objects and advantages of the present invention will become more apparent to those persons having ordinary skill in the art to which the present invention pertains, from the following description taken in conjunction with the accompanying drawings, wherein.

Figure 1:
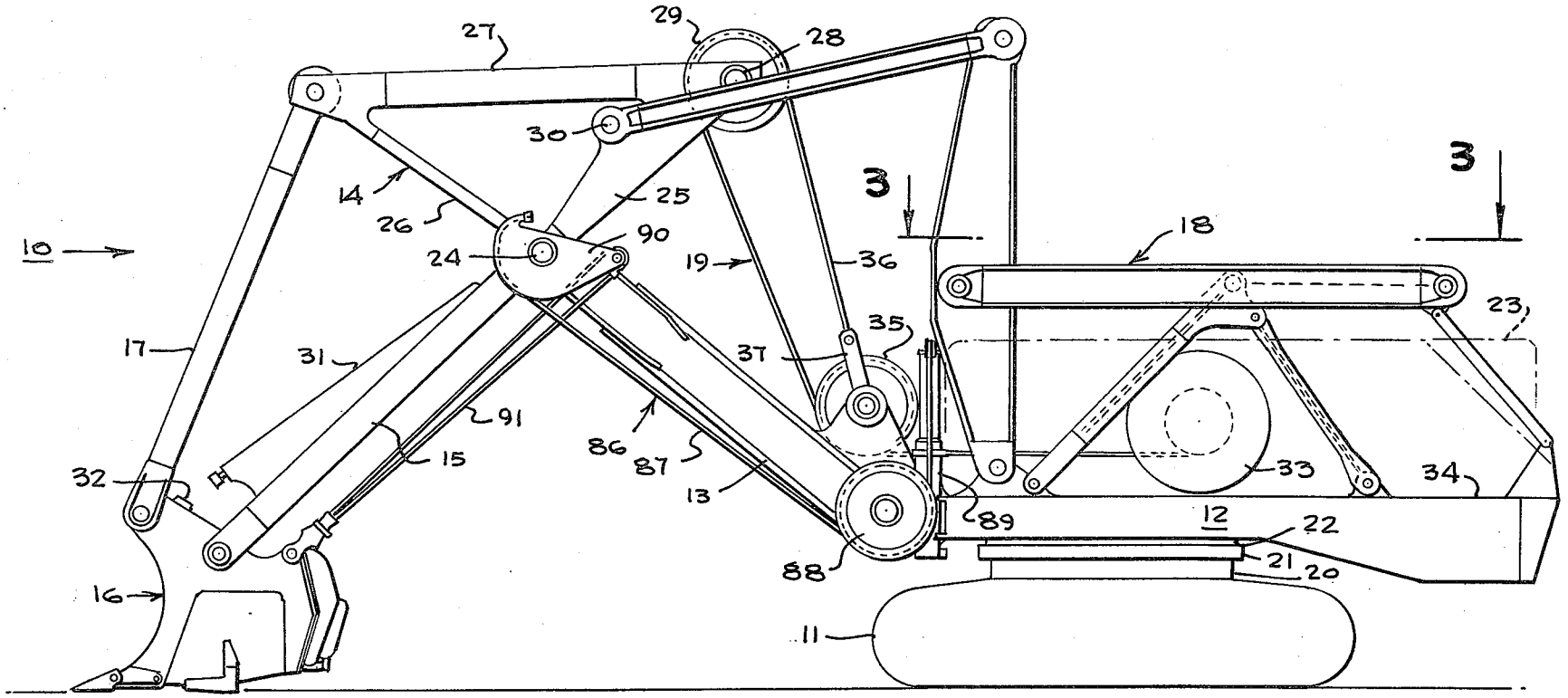
FIG. 1 is a side elevational view of a power shovel having a crowd system embodying the present invention.

Referring to the drawings, there is illustrated a power shovel 10 generally including a crawler unit 11, a main frame 12 rotatably mounted on the crawler unit, a stiffleg 13 pivotally connected at its lower end to the main frame, a hoist frame 14 pivotally connected to the upper end of stiffleg 13, a dipper handle 15 pivotally connected to the outer end of stiffleg 13 (although the dipper handle alternatively may be pivotally connected to hoist frame 14), a dipper 16 pivotally connected to the outer end of dipper handle 15, a hoist link 17 pivotally connected to hoist frame 14 and dipper 16, a crowd system 18 mounted on main frame 12 and operatively connected to hoist frame 14, and a hoist mechanism 19 mounted on main frame 12 and operatively connected to hoist frame 14.

Crawler unit 11 may be of any conventional design and has mounted thereon a lower frame 20 which supports a conventional roller circle 21. An upper frame 22 is seated on the roller circle and is adapted to support main frame 12. Appropriate machinery is provided on main frame 12 to drive the crawler unit and swing the upper frame 12 and main frame 22 about a center journal relative to lower frame 20 and the crawler unit, as is conventional in the prior art. Such propelling and swing machinery is housed in a cab structure 23 provided on the main frame 12 which also houses other machinery and components of the shovel as later will be described.

The lower end of stiffleg 13 is bifurcated, providing a pair of feet which are pivotally connected to main frame 12 by means of a pair of foot pins thus permitting the stiffleg to be pivoted in a vertical plane. The outer, upper end of stiffleg 13 is provided with a head shaft 24 on which is pivotally mounted various components including the dipper handle and hoist frame. Dipper handle 15 generally consists of a pair of transversely spaced, longitudinally disposed beams pivotally connected at the outer ends thereof to the side walls of the dipper, interconnected along the length thereof by bracing members, and pivotally connected at the upper ends thereof to head shaft 24.

Hoist frame 14 has substantially a triangular configuration and includes a base member 25 pivotally mounted on head shaft 24, a post member 26 being disposed substantially perpendicular to base member 25 and having the lower end thereof integrally connected to the front end of the base member, and a tension member 27 integrally interconnecting the upper end of the post member 26 and the rear end of base member 25. In an alternate embodiment of the hoist frame in which the upper end of the dipper handle is pivotally connected to the hoist frame, the forward end of base member 25 is bifurcated, providing a pair of forwardly projecting arm portions to which the upper end of the dipper handle is pivotally connected. As illustrated in FIG. 1, a shaft 28 is provided at the rear end of base member 25 on which there is rotatably mounted a hoist sheave 29 for operatively connecting the hoist system to the hoist frame, as later will be described. Also mounted on the base member substantially intermediate the head shaft and hoist sheave support shaft is a rigidly mounted connecting pin 30 for operatively connecting the crowd system to the hoist frame.

Dipper 16 is substantially of a conventional construction including a pair of transversely spaced side walls, a bottom wall, a plurality of digging teeth detachably mounted on the front lip of the bottom wall and a releasable door pivotally connected at its upper end to the side walls of the dipper. The dipper is adapted normally to pitch upwardly, the upward pitch being limited by a pitch stop 31 mounted on the upper side of the dipper handle. The pitch stop consists of a pair of beams mounted at an angle to the side beams of the dipper handle. The ends of the beams are engagable with abutment pads 32 rigidly mounted on the side walls of the dipper adjacent the pivotal connection of the dipper with hoist link 17.

Hoist system 19 is substantially conventional in design and generally includes a hoist drum and drive 33 mounted on support platform or main deck 34 of main frame 12 within the cab structure, a sheave 35 mounted on the lower end of the stiffleg and a hoist line 36 operatively connected at one end to hoist drum 33, passing around sheaves 35 and 29 and being deadended at the lower end of the stiffleg, as at 37. As in the conventional manner, whenever the hoist line is either payed out or taken in, hoist frame 14 and correspondingly dipper handle 15, dipper 16 and hoist link 17 will be caused to pivot about the head shaft mounted on the upper end of the stiffleg.

Figure 2:
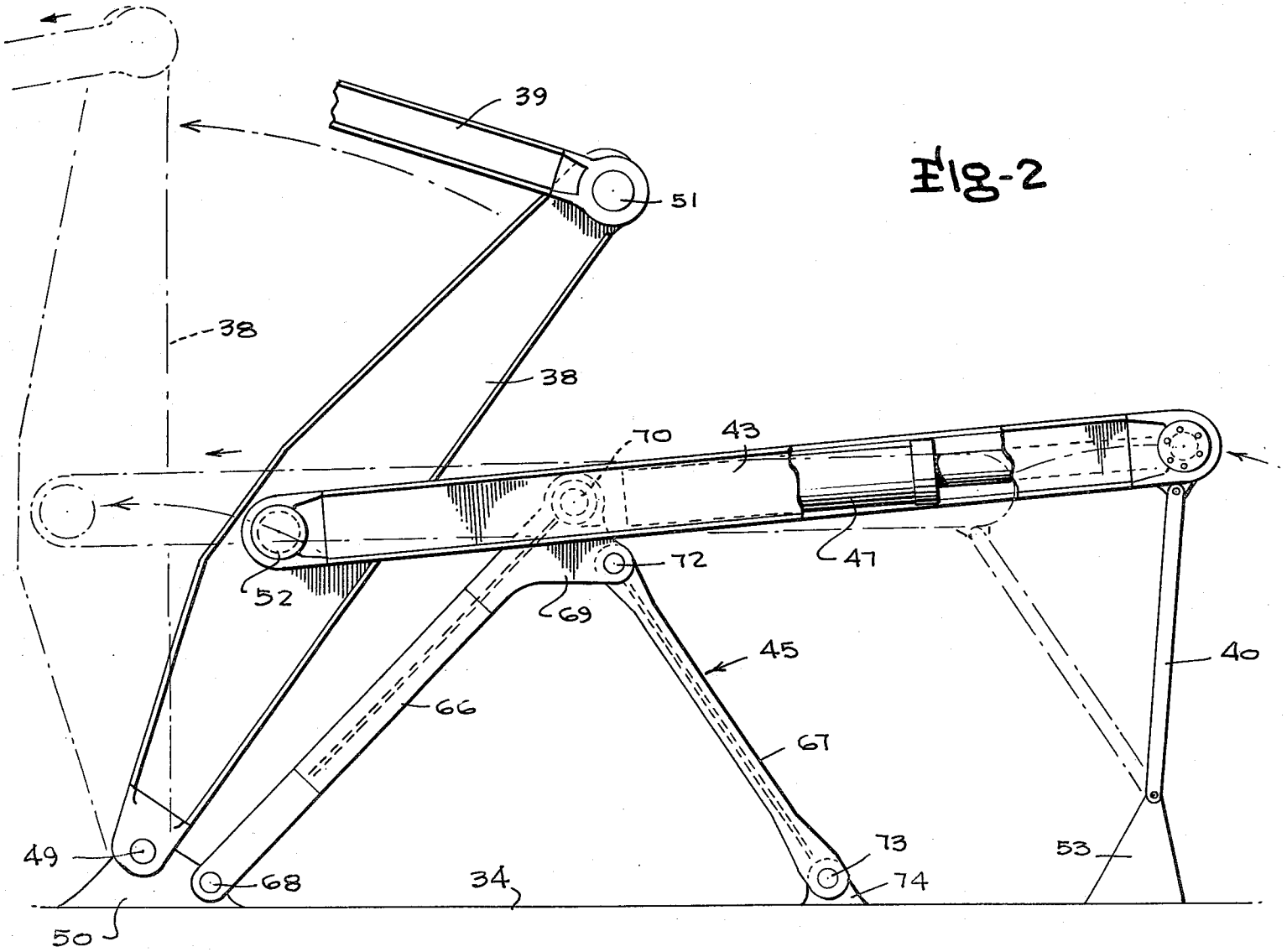
FIG. 2 is an enlarged, side elevational view of the crowd system illustrated in FIG. 1.
Figure 3:
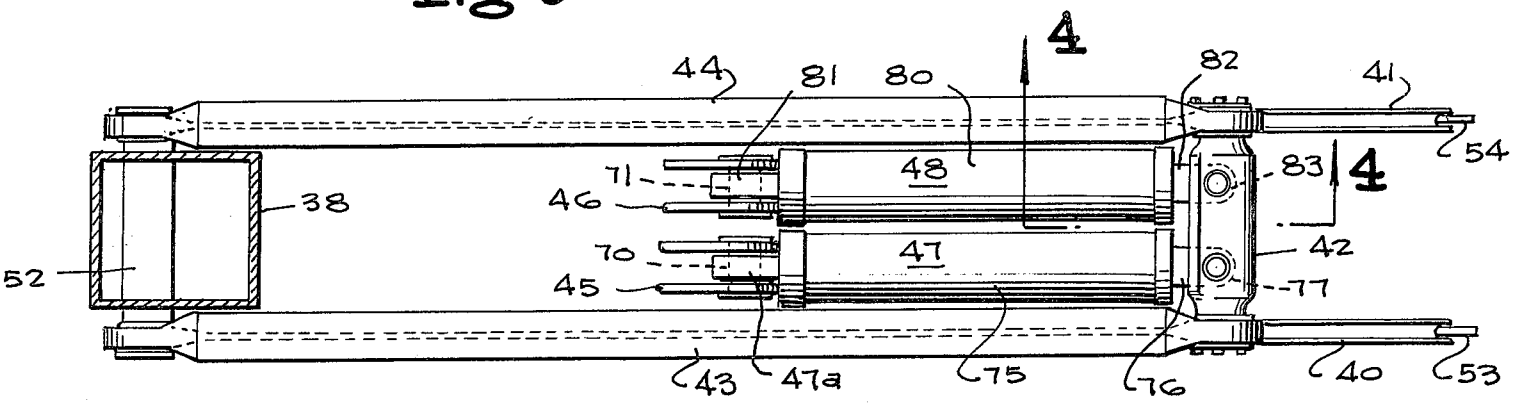
FIG. 3 is an enlarged, cross-sectional view taken along line 3—3 in FIG. 1.

The crowd system 18 generally consists of a linkage as best illustrated in FIG. 2 and a fluid actuating system mounted on the main frame of the shovel and operatively connected to the actuating components of the linkage. As best seen in FIGS. 2 and 3, the linkage includes a mast 38, a pair of connecting links 39, a pair of transversely spaced support links 40 and 41, a cross-piece member 42, a pair of drive links 43 and 44, a gantry 45 and a pair of fluid actuated, piston and cylinder assemblies 47 and 48. Mast 38 is pivotally connected at the lower end thereof by means of a pin or pins 49 to mounting brackets 50 disposed on the support platform 34 and rigidly secured to main frame 12, forwardly of the vertical centerline of rotation of the main frame. Mounted on the upper end of the mast is a transversely disposed connecting pin 51, to which the rearwardly disposed ends of connecting links 39 are pivotally connected. The mast further is provided with a transversely disposed shaft 52 disposed intermediate the ends thereof, having the end portions thereof projecting laterally of the side walls of the mast.

As best illustrated in FIG. 3, mast 38 is connected to the main frame of the shovel for pivotal movement in a vertical plane including the longitudinal centerline of the shovel. Spaced rearwardly of the mast, adjacent the rear end of the main frame, and disposed on opposite sides of the adjacent to the longitudinal centerline of the shovel are mounting brackets 53 and 54. Support links 40 and 41 consist of rigid members and are pivotally connected at the lower ends thereof to mounting brackets 53 and 54 for pivotal movements in vertical planes disposed on opposite sides and parallel to the plane of movement of the mast. Crowd drive links 43 and 44 consist of elongated structural members which interconnect the intermediate portion of the mast and the upper ends of support links 40 and 41. The front ends of the crowd drive links are pivotally connected to the laterally projecting portions of shaft 52 mounted on the mast, and the rear ends thereof are provided with depending brackets 55 and 56 which are pivotally connected to the upper ends of the support links by means of connecting pins 57 and 58. It thus will be seen that the front ends of the crowd drive links are supported on the intermediate portion of the mast and the rear ends thereof are supported on the support links so that when the mast is in the substantially vertical position, the crowd drive links will be disposed substantially above and parallel to main deck 34. It further will be noted from FIG. 1 that the crowd drive links will be disposed above cab structure 23 or at least clear of the deck space on which other components and equipment are mounted.

Figure 5:
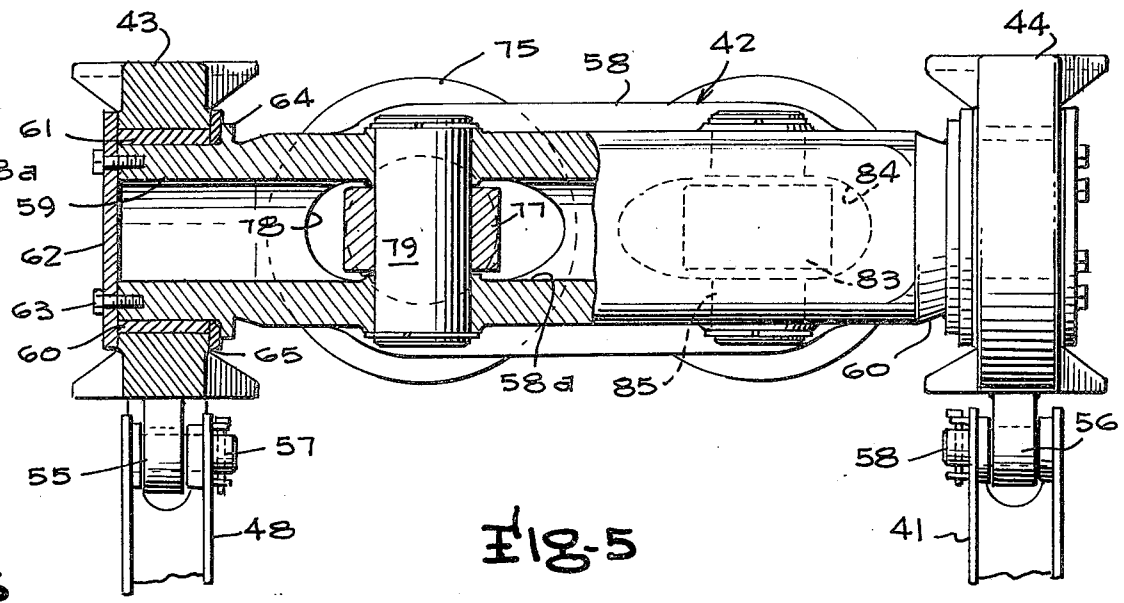
FIG. 5 is a cross-sectional view taken along line 5—5 in FIG. 4.
Figure 4:
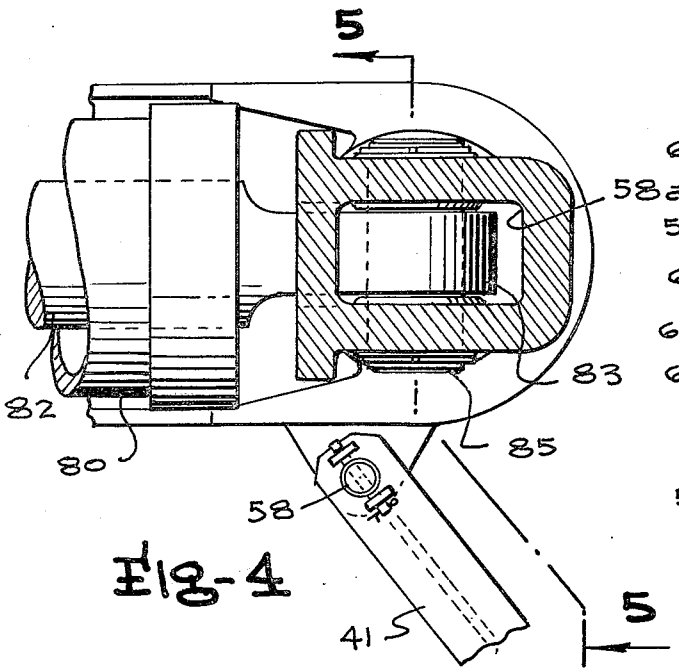
FIG. 4 is an enlarged, cross-sectional view taken along line 4—4 in FIG. 3.

Cross-piece member 42 consists of a main body portion 58 and a pair of trunion portions 59 and 60, and is provided with a transversely disposed opening **58*a*. The trunion portions are journaled bushings 60 disposed in transversely aligned openings 61 provided in the rear ends of the crowd drive links, as best illustrated in FIG. 5. The spacing of the rear ends of the crowd drive links is maintained by means of retainer plates 62 mounted on the outer ends of the trunion portions and secured thereto by cap screws 63, and annular flanges 64 which abut annular spacers 65** disposed between the flanges and the rear ends of the crowd drive links.

As best illustrated in FIG. 2, gantry 45 consists of a front leg 66 and a pair of rear legs 67. The lower end of front leg 66 is rigidly connected to mounting bracket 50 by means of a connecting pin 68 and the upper end thereof is provided with a portion 69 disposed between the intermediate portions of crowd drive links 43 and 44. Upper portion 69 is provided with a set of transversely spaced, upwardly projecting brackets provided with transversely aligned connecting pins 70 and 71, and sets of transversely spaced, rearwardly projecting brackets provided with transversely aligned connecting pins 72. Rear legs 67 consist of rigid members and are connected at the upper ends thereof to connecting pins 72, and at the lower ends thereof by means of connecting pins 73 to mounting brackets 74 disposed on the main deck and rigidly secured to the main frame.

Disposed on opposite sides of the longitudinal centerline of the shovel, between crowd drive links 43 and 44, are piston and cylinder assemblies 47 and 48. As best seen in FIG. 3, assembly 47 consists of a cylinder 75 provided with a bracket **47*a* pivotally connected to the upper end of gantry 45 by means of connecting pin 70, and a piston 76 having a bracket 77 which projects through an opening 78 provided on the front side of the cross-piece member, into opening 58*a* thereof, and is pivotally connected to a vertical pin 79 mounted in a pair of vertically aligned openings in the main body portion of the cross-piece member. Similarly, assembly 48 consists of a cylinder 80 having a bracket 81 pivotally connected to the upper end of gantry 45 by means of connecting pin 71, and a piston 82 having a bracket 83 projecting through an opening 84, into transverse opening 58a in the cross-piece member, and pivotally connected to a vertical pin 85 mounted in vertically aligned openings in the main body portion of the cross-piece member. It thus will be seen that the front ends of assemblies 47 and 48 are pivotally connected to gantry 45 for pivotal movements in parallel, vertical planes, and the rear ends thereof are substantially universally connected to the rear ends of the crowd drive links and correspondingly the upper ends of the support links. It further will be seen that when the pistons of assemblies 47 and 48 are fully retracted, the mast, crowd drive links and support links will be disposed in positions as illustrated by the phantom lines in FIG. 2, and further that when the pistons thereof are extended, the mast, crowd drive links and support links will assume the positions illustrated by the solid lines in FIG. 2** thereby retracting the front end assembly of the shovel.

During the crowding phase of the digging cycle of the shovel, the pitch of dipper 16 can be maintained fixed relative to the main frame of the shovel by means of a pitch control system 86 consisting of a pair of pantograph linkages 87 mounted on opposite sides of the stiffleg and dipper handle, a pair of sheaves 88 mounted on the foot pins of the stiffleg, and a pair of fluid actuated piston and cylinder assemblies 89 having the cylinders thereof rigidly secured to the main frame. The pantograph linkages 87 are substantially identical in construction and operation. As illustrated in FIG. 1 and described in greater detail in U.S. Pat. Nos. 3,501,034 and 3,648,863, each linkage 87 consists of a bell crank 90 pivotally mounted on the outer end of head shaft 24, connected at one end thereof to the forwardly disposed end of the pitch bell crank, reeved about sheave 88 and connected at the opposite end to the piston portion of cylinder assembly 89, and a pitch link 91 connected at one end thereof to a rearwardly disposed point on the pitch bell crank and connected at the opposite end thereof to a side wall of the dipper.

The dipper pitch control system as described operates in a manner whereby whenever the pistons of cylinder assemblies 89 are permitted to float freely, the pitch of the dipper will be permitted to change with respect to the forces imposed by its own weight or contact of the dipper with the ground of material being excavated. However, upon locking the pistons of cylinder assemblies 89, the pantograph linkages will cause the pitch of the dipper to become fixed relative to the main frame of the shovel until such pistons are released and again permitted to float freely.

In the operation of the embodiment as described, the front end assembly of the shovel is positioned at the beginning of the digging cycle by operating the crowd system to pivot the stiffleg to its rearmost position, operating the hoist system to lower the dipper downwardly and rearwardly to a position adjacent the stiffleg, and rendering inoperative the holding means of the dipper pitch control system so that the dipper will be caused to pitch upwardly. In retracting the front end assembly to so position the dipper, fluid under pressure is supplied to the front ends of cylinders 75 and 80 to extend pistons 76 and 82. With the front end assembly in its fully retracted position, the crowd system will be positioned as illustrated in FIG. 2 of the drawings.

With the front end assembly in its fully retracted position as described, the digging cycle of the shovel may commence merely by permitting fluid to be discharged from the piston ends of the cylinders, and possibly supplying fluid under pressure to the rod ends of the cylinders. Such action causes pistons 76 and 82 to retract, correspondingly causing the stiffleg to pivot downwardly under the force of the weight of the front end assembly and possibly any force exerted by the crowd system. Simultaneously, the hoist system is operated to take in hoist line and permit the dipper handle to pivot forwardly, away from the stiffleg, to provide a knee-type action characteristic of the type of shovel described. As such knee-action progresses, the dipper will be caused to pivot so that the bottom wall thereof will be seated on the ground in a horizontal position. The operator then actuates certain controls to lock the pistons of the cylinder assemblies 89 whereupon, as the knee-action of the front assembly continues, the dipper pitch control system will cause the pitch of the dipper to remain fixed and the dipper to be crowded into the material being excavated, along a horizontal line of travel, to a maximum extended position.

At the end of the crowding phase of the digging cycle when the dipper has made its maximum penetration into the material being excavated, the operator actuates appropriate controls to supply fluid under pressure to the piston ends of cylinders 75 and 80 to extend pistons 76 and 82 and correspondingly retract the front end assembly. Simultaneously, the operator actuates appropriate controls to release the piston of cylinder assemblies 89 thus permitting the dipper to pitch upwardly until the pads 32 of the dipper engage pitch stop 31. As such action occurs, the hoist line continues to be taken in thus causing the dipper to be hoisted until it reaches a dump position. In such position, the dumping door of the dipper will be disposed substantially horizontal and the dipper will be filled with a maximum load of material ready to be dumped. The swing mechanism on the shovel may then be operated to swing the dipper to a position over the location where the material is to be dumped, and the door may be unlatched to discharge the material. From such point on, the hoist system is operated to pay out hoist line and the swing machinery are operated to return the front end assembly into position to begin the next digging cycle.

Referring to FIG. 2, it will be appreciated that when pistons 76 and 82 are extended, support links 40 and 41 will be caused to pivot rearwardly to the position as illustrated by solid lines. Correspondingly, such motion will be transmitted through crowd drive links 43 and 44 to mast 38 causing the mast also to pivot rearwardly to a position as illustrated by solid lines. The rearward pivotal movement of the mast is transmitted through connecting links 39 to hoist frame 14, correspondingly causing stiffleg 13 to pivot rearwardly, thus retracting the entire front end assembly. When pistons 76 and 82 are then retracted, the components of such linkage are cause to return to the positions as illustrated by phantom lines in FIG. 2.

In the preferred embodiment of the present invention, a pair of cylinder assemblies are utilized which are positioned close together along the longitudinal centerline of the main frame of the shovel. It further is contemplated, however, that a single cylinder assembly could be used, positioned along the centerline of the main frame, or a greater number of assemblies, positioned symmetrically relative to the centerline could be used. As an example, three smaller cylinder assemblies could be used with one positioned on the centerline and the other two positioned on opposite sides of the center assembly, closely adjacent thereto.

Also in the preferred embodiment of the invention, cylinder brackets 47a and 81 are mounted on narrow, contoured bushings disposed on pins 70 and 71, which, in combination with pins 79 and 85, allow some slight misalignment of the cylinders. Preferably, the ends of the openings in such bushings are flared or tapered providing frusto-conically configured surfaces of a slight angle, in the order of one degree, and having an axial dimension of about one-fourth the length of bushing.

It will be appreciated that the type of crowd system described has the advantages of providing (a) additional open space on the main deck to accomodate other components and equipment of the shovel, (b) easier servicing of the crowd machinery by virtue of the cylinders being more readily accessible to maintenance personnel and lifting cranes, (c) improved efficiencies of the moving connections of the components thereof due to less frictional loss, (d) the displacement of the center of gravity of the crowd system further aft thus enhancing the stability of the shovel, (e) no moving components within the cab structure which might cause injury to operating personnel, (f) a greater variation in component and equipment layouts on the main deck, (g) superior kinematic characteristics of the system, made possible by the small variation of the moment arm of the cylinders about the foot pin, (h) a minimum opportunity for the spillage of oil on electrical equipment, and (i) a minimum opportunity for oil to spill on walkways which could result in injury to operating personnel.

From the foregoing detailed description, it will be evident that there are a number of changes, adaptations and modifications of the present invention which come within the province of those persons having ordinary skill in the art to which the present invention pertains. However, it is intended that all such variations not departing from the spirit of the present invention be considered as within the scope thereof, as limited solely by the appended claims.

I claim:

1. A crowd system for a power shovel having a front end assembly and body including a dipper mounted on said body, and means mounted on said body and operatively connected to said front end assembly for hoisting said dipper, comprising a mast pivotally connected at a lower end thereof to said body, at least one connecting link pivotally connected at opposite ends thereof to said mast and said front end assembly, at least one support link pivotally connected at a lower end thereof to said body, a drive link pivotally connected at opposite ends thereof to said mast and said support link, a gantry mounted on said body, at least one fluid actuated, piston and cylinder assembly pivotally connected at one end thereof to said gantry at a point elevated relative to a support platform of said body, and pivotally connected at an opposite end thereof to said crowd drive link, and means for selectively supplying fluid under pressure to at least one end of the cylinder of said piston and cylinder assembly.

2. A crowd system according to claim 1 wherein said piston and cylinder assembly is disposed substantially along the longitudinal centerline of said body.

3. A crowd system according to claim 1 wherein said piston and cylinder assembly is spaced substantially parallel to said support platform.

4. A crowd system according to claim 1 wherein said drive link and said piston and cylinder assembly are disposed in a plane disposed substantially parallel to said support platform.

5. A crowd system according to claim 1 including a pair of drive links, each disposed on a side of and adjacent to the centerline of said body.

6. A crowd system according to claim 5 wherein said piston and cylinder assembly is disposed between said drive links.

7. A crowd system according to claim 6 including a cross piece member interconnecting said drive links, to which said piston and cylinder assembly is pivotally connected.

8. A crowd system according to claim 5 including a cross-piece member interconnecting said drive links, and a pair of piston and cylinder assemblies disposed between said drive links, each of said piston and cylinder assemblies being disposed on a side of and adjacent to the center line of said body and having the rearward end thereof pivotally connected to said cross piece member.

9. A crowd system according to claim 8 wherein said drive links and said piston and cylinder assemblies are disposed in a plane spaced substantially parallel to said support platform.

10. A crowd system according to claim 8 wherein an upper end of said gantry is disposed between said drive links and the forward end of said piston and cylinder assemblies are pivotally connected to said upper end of said gantry.

11. A crowd system according to claim 8 wherein said cross-piece member includes a pair of substantially vertical pins to which said piston and cylinder assemblies are connected.

12. A crowd system according to claim 11 wherein said piston and cylinder assemblies are pivotally connected to a set of pins mounted on said gantry, provided with bushings having slightly tapered opening ends, which cooperate with said pins on said cross-piece member to permit a slight misalignment of said piston and cylinder assemblies.

* * * * *